US007334378B2

(12) United States Patent
Noumi

(10) Patent No.: US 7,334,378 B2
(45) Date of Patent: Feb. 26, 2008

(54) PACKAGING MACHINE AND WEIGHING APPARATUS

(75) Inventor: Kenji Noumi, Kitakyushu (JP)

(73) Assignee: Plus One Techno & Co., Ltd., Kitakyushu-shi (JP)

( * ) Notice: Subject to any disclaimer, the term of this patent is extended or adjusted under 35 U.S.C. 154(b) by 0 days.

(21) Appl. No.: 10/583,314

(22) PCT Filed: Jun. 11, 2004

(86) PCT No.: PCT/JP2004/008208

§ 371 (c)(1),
(2), (4) Date: Jun. 15, 2006

(87) PCT Pub. No.: WO2005/061329

PCT Pub. Date: Jul. 7, 2005

(65) Prior Publication Data

US 2007/0119632 A1 May 31, 2007

(30) Foreign Application Priority Data

Dec. 18, 2003 (JP) ..... 2003-273248

(51) Int. Cl.
*B65B 9/20* (2006.01)
*B65B 57/04* (2006.01)

(52) U.S. Cl. ..... 53/53; 53/551

(58) Field of Classification Search ..... 53/53
See application file for complete search history.

(56) References Cited

U.S. PATENT DOCUMENTS 2,847,807 A * 8/1958 Brook ..... 53/53
3,415,369 A * 12/1968 Hennig ..... 209/600
3,592,049 A * 7/1971 Johanski, Jr. ..... 73/45.2
3,889,447 A * 6/1975 Garris ..... 53/53
4,011,155 A * 3/1977 Feurstein et al. ..... 209/3.1
4,164,260 A * 8/1979 Blodgett ..... 177/1
4,510,730 A * 4/1985 Edmondson ..... 53/53
4,813,205 A * 3/1989 Mikata et al. ..... 53/53
4,928,473 A * 5/1990 Nagao et al. ..... 53/53
5,313,766 A * 5/1994 Rimondi et al. ..... 53/451
5,832,700 A * 11/1998 Kammler et al. ..... 53/502
6,910,313 B2 * 6/2005 De Cardenas et al. ..... 53/53

FOREIGN PATENT DOCUMENTS

JP 56-144714 U 10/1981
JP 06099952 A * 4/1994
JP 7-285502 A 10/1995
JP 11-263374 A 9/1999
JP 2003-128009 A 5/2003

* cited by examiner

*Primary Examiner*—John Sipos
(74) *Attorney, Agent, or Firm*—Kubovcik & Kubovcik

(57) ABSTRACT

A packaging machine and a weighing apparatus low in equipment cost, small in installation space, and allowing a reduction in time required from the manufacture of packaged bodies to the completion of weighing to increase productivity. The stick packaged bodies are weighed by a weighing load cell in the housing of the stick packaging machine. Accordingly, the stick packaged bodies must not be fed to a weighing stage apart from the packaging machine by a belt conveyor. Therefore, the equipment cost can be reduced, and the installation space for the stick packaged bodies including peripheral equipment can also be reduced. In addition, the productivity can be increased since the time required for the stick packaged bodies to pass a weighing requirement to be formed in products is shortened.

3 Claims, 14 Drawing Sheets

PACKAGING MACHINE AND WEIGHING APPARATUS

FIELD OF THE ART

The present invention relates to a packaging machine and a weighing machine, and specifically relates to an improvement of a packaging machine for manufacturing packaging, in which contents, such as a powder, bulk body, or liquid of a food, medical drug, etc., are packaged, and an improvement of a weighing, machine that weighs a weight of an arbitrary object to be weighed, such as a powder, bulk body, or liquid, discharged from any one of various manufacturing apparatuses.

BACKGROUND ART

A stick type packaging (packaging) that packages, for example, a food or a medical drug of powder form, in a rod-like form has been developed recently. The material of the stick type packaging is a laminated film, formed by laminating a polyethylene terephthalate film, an aluminum foil, a polyethylene film, etc. The stick packaging is formed by bringing together and heat-sealing longitudinal edges (longitudinal sealed portions) at both sides in a width direction of the laminated film, and then heat-sealing lateral edges (pair of lateral sealed portions) at both sides in a length direction of the laminated film, which has thus been made cylindrical in form. The stick packaging is rod-like in form. It is therefore highly portable and convenient and can be opened readily. However, the stick packaging is a bag with a special shape. It is thus manufactured using a specialized stick packaging machine.

As an example of a conventional stick packaging machine (packaging machine), there is that described in Patent Document 1. The stick packaging machine of Patent Document 1 includes a supplying unit that supplies a laminated packaging sheet wound around a reel, a hopper that drops contents into a pre-packaging body that is in a state in which an upper portion is unsealed, a guiding cylinder unit that shapes the packaging sheet into cylindrical form, a longitudinal seal forming unit that adheres together longitudinal edges of the packaging sheet that has been made cylindrical in form, a lateral seal forming unit that adheres together lateral edges in a length direction, a cutter that forms a notch at an end of one of the lateral edges, and a lateral seal cutting unit that cuts the lateral edge to form the stick packaging.

In manufacturing the stick packaging, first, the packaging sheet is lead out from the reel by the supplying unit. The packaging sheet is then shaped to a cylindrical shape by the guiding cylinder unit, and the longitudinal edges of the packaging sheet that has been made cylindrical in form are adhered together by the longitudinal seal forming unit to form a longitudinal sealed portion. A lateral sealed portion is then formed by the lateral seal forming unit successively adhering together the cylindrical packaging sheet at a predetermined pitch, and the contents (for example, sugar) inside the hopper are dropped and filled into the pre-packaging body in the state in which the upper portion is unsealed. An upper end of the pre-packaging body is then sealed by the lateral seal forming unit, and a notch (cut) is formed in one of the lateral sealed portions by the cutter. The lateral sealed portions are then cut successively by the lateral seal cutting unit. As a result, stick packagings are manufactured successively.

Patent Document 1: Japanese Published Unexamined Patent Application No. H11-263374.

DISCLOSURE OF THE INVENTION

Object(s) of the Invention

However, with the stick packaging machine of Patent Document 1, weighing, for inspection of whether the contents filled in a stick packaging are filled correctly to within a weight error set in advance, is performed after discharge of the stick packaging from inside the stick packaging machine.

A weighing stage thus had to be installed separately in a factory, and a belt conveyor or other transferring apparatus for transferring the stick packaging from the stick packaging machine to the weighing stage was required separately. As a result, the equipment cost was high, the installation space used for the entirety of the equipment for manufacturing stick packagings was large, a long time was required for a stick packaging to pass the weighing inspection and become a product, and the productivity was low.

An object of the present invention is to provide a packaging machine that is inexpensive in equipment cost, is small in installation space, shortens the time from manufacture of a packaging to the end of weighing, and enables improvement of productivity.

Another object of the present invention is to provide a packaging machine that can weigh packagings at high precision reliably.

Yet another object of the present invention is to provide a packaging machine that can select and discharge just non-defective items from a packaging discharging unit.

Yet another object of the present invention is to provide a packaging machine that, although being simple and inexpensive in structure, can remove packagings, judged to be defective by weighing, from the packaging discharging unit reliably.

Yet another object of the present invention is to provide a packaging machine, with which not only a new packaging machine but even an existing packaging machine can be modified readily to a packaging machine exhibiting the effects of the present invention.

Yet another object of the present invention is to provide a weighing machine that is inexpensive in equipment cost, is small in installation space, shortens the time from manufacture of a weighed object to the end of weighing, and enables improvement of productivity.

Yet another object of the present invention is to provide a weighing machine that, although being simple and inexpensive in structure, can load weighed objects, discharged from a defective item outlet, into a defective item recovery box reliably.

Yet another object of the present invention is to provide a weighing machine that enables changing of recovery positions of defective weighed objects according to defect conditions and enable defective weighed objects to be recovered at a substantially uniform height in the defective item recovery box.

SUMMARY OF THE INVENTION

A packaging machine according to a first claim of the present invention is a packaging machine that overlaps both longitudinal edges of a single packaging sheet, having a strip shape, or opposing longitudinal edges of two packaging sheets, each having a strip shape, seals the overlapped portions of the packaging sheet or sheets to shape the packaging sheet or sheets into a cylindrical shape, then seals a lower end of a pre-packaging body in the middle of manufacturing a packaging, then fills the pre-packaging body with a predetermined amount of contents, then after sealing an upper end of the above-mentioned pre-packaging body, cuts the sealed portion at the upper end of the pre-packaging body, and discharges the packaging thus obtained out of the machine by means of a packaging discharging unit, and in this packaging machine, the above-mentioned packaging discharging unit is incorporated inside the above-mentioned packaging machine, and the above-mentioned packaging discharging unit is provided with a means for weighing the above-mentioned packaging that is manufactured.

With the invention according to the first claim, the manufactured packaging is weighed by the weighing machine in the middle of being discharged out of the machine via the packaging discharging unit. Because a packaging weighing stage is thus incorporated inside the packaging machine, the equipment cost is made inexpensive, the installation space is made small, the time from the manufacture of the packaging to the end of weighing is shortened, and the productivity can be improved.

As the packaging sheet, for example, a laminated film, formed by laminating a polyethylene terephthalate film, an aluminum foil, a polyethylene film, etc., can be employed.

As the packaging, for example, a stick packaging, a three-side-sealed packaging, a four-side-sealed packaging, etc., can be employed. A three-side-sealed packaging is a packaging with a rectangular shape with which three sides are sealed. A four-side-sealed packaging is a packaging with a rectangular shape in front view with which four sides are sealed.

The strip-shaped packaging sheet is stored in a packaging sheet supplying unit in a state of being wound around a reel or in a zigzag-folded state.

The sealing of both longitudinal edges of the packaging sheet is performed by a longitudinal seal forming unit. The sealing of the upper end and the lower end of the packaging sheet is performed by a lateral seal forming unit. As each of the longitudinal sealing unit and the lateral sealing unit, a heat sealer may be employed.

As contents filled in the packaging, for example, a food item, such as instant coffee, instant milk, sugar, salt, etc., or a medical drug of granular or powder form may be employed. Any one of various liquid materials or bulk materials may also be used.

The contents are contained in a hopper or other contents storing unit. As a contents supplying unit, for example, a metering pump may be employed.

The cutting of the sealed portion at the upper end of the pre-packaging body is performed by a lateral seal cutting unit having a cutter and a cutter moving means that moves the cuter laterally.

Two (double), three (triple), or more sets of a principal portion of the packaging machine, which includes the supplying unit, longitudinal seal forming unit, lateral seal forming unit, contents storing unit, contents supplying unit, and lateral seal cutting unit, may be installed in a main apparatus body of the packaging machine.

The packaging discharging unit has a packaging discharging passage leading from the lateral seal cutting unit to the exterior of the machine. There may be just one discharging passage or two or more discharging passages.

The arrangement of the weighing means is not restricted. The weighing means may, for example, be arranged from a weighing bucket and a weighing load cell that is a weighing apparatus.

The number of weighing means installed in the main apparatus body may be set in accordance to the number of principal packing machine components installed.

A packaging machine according to a second claim of the present invention is a packaging machine according to a first claim that includes the weighing means with a weighing bucket receiving the packaging and a weighing load cell being disposed on the weighing bucket and measuring the weight of the packaging.

With the invention according to the second claim, because the weighing means has the weighing bucket, which receives the packaging, and the weighing load cell, which is connected to the weighing bucket, the packaging can be weighed reliably at high precision.

The shape of the weighing bucket is not restricted. An arrangement having a chute that discharges the packaging after weighing is preferable. In this case, an automatic opening/closing door may be provided at a packaging outlet.

A packaging machine according to a third claim of the present invention is a packaging machine according to a second claim that the packaging discharging unit has a housing, and in the housing are housed the weighing means, a discharging chute, being disposed at a portion of the packaging discharging unit downstream the weighing means and discharging the packaging out of the machine, a defective item removing means, being disposed on the discharging chute and removing defective packagings judged by weighing to be outside a weight range of non-defective items, and a non-defective item counter, being disposed at an end portion of the discharging chute at the side at which the packagings that are non-defective are discharged and counting the number of non-defective packagings that have passed through the discharging chute, and in the defective item removing means are disposed an opening/closing lid, opening and closing a defective item outlet, formed in a portion of the discharging chute, by being rotated within a vertical plane, and a lid rotating means, rotating the opening/closing lid within the vertical plane.

With the invention according to the third claim, a packaging that is judged to be defective in the weighing process is removed by the defective item removing means at the portion downstream the weighing stage of the packaging discharging unit. Just the non-defective items can thereby be selected and discharged from the packaging discharging unit.

In the middle of discharging the defective packaging from the discharging chute, the opening/closing lid is rotated to the defective item outlet opening side by the lid rotating means and the defective item is placed into the defective item outlet. A packaging that is judged to be defective by weighing can thereby be removed reliably from the packaging discharging unit by a simple and inexpensive structure.

Also, because the packaging discharging unit having the weighing means is arranged as a unit, not just a new packaging machine but even an existing packaging machine can be modified easily to a packaging machine that exhibits the effects of the present invention.

The structure of the defective item removing means is not restricted. For example, a defective packaging may be removed by grasping by a grasping means.

The size and shape of the housing are not restricted. The housing may be fixed to the main apparatus body or may be detachable with respect to the main apparatus body.

A weighing machine according to a fourth claim of the present invention is a weighing machine that has a housing, a conveying passage, being housed in the housing and conveying an object to be weighed from an inlet to an outlet that are formed apart from each other in the housing, and a weighing means, disposed on the conveying passage, the weighing means in turn has a weighing bucket, receiving the object to be weighed, and a weighing load cell, being connected to the weighing bucket and measuring the weight of the object to be weighed.

With the invention according to the fourth claim, the object to be weighed is weighed by the weighing means in the process of discharge to the exterior of the machine through the conveying passage. Because the object to be weighed is thus weighed by the weighing means inside the housing, when, for example, the weighing machine is positioned near a product outlet of an apparatus that manufactures the object to be weighed, a belt conveyor or other transferring apparatus that transfers the object to be weighed to the weighing stage as in the conventional case is made unnecessary. The equipment cost is thus made inexpensive, the installation space used by the entirety of the equipment that manufactures the object to be weighed is made small, the time required for the object to be weighed to pass the weighing inspection and become a product is shortened, and the productivity can be improved.

Also, because the weighing means has the weighing bucket, which receives the packaging, and the weighing load cell, which is connected to the weighing bucket, the packaging can be weighed reliably at high precision.

The type of the weighed object is not restricted. For example, any one of various types of powders, bulk bodies, and liquids may be employed.

As the conveying passage, for example, a chute or an endless conveyor may be employed.

The arrangement of the weighing means is not restricted. The weighing means may, for example, be arranged from a weighing bucket and a weighing load cell that is a weighing apparatus.

A weighing machine according to a fifth claim of the present invention is a weighing machine according to the fourth claim that in the housing are housed a discharging chute, being disposed at a portion of the conveying passage downstream the weighing bucket and discharging the weighed object to the exterior of the machine, a defective item removing means, being disposed on the discharging chute and removing defective weighed objects that are judged by weighing to be outside a weight range of non-defective items, and a non-defective item counter, being disposed at an end portion of the discharging chute at the side at which the weighed objects that are non-defective are discharged and counting the number of non-defective weighed objects that have passed through the discharging chute, and in the defective item removing means are disposed an opening/closing lid, opening and closing a defective item outlet, formed in a portion of a bottom plate of the discharging chute, by being rotated within a vertical plane, and a lid rotating means, rotating the opening/closing lid within the vertical plane.

With the invention according to the fifth claim, a weighed object that is judged to be defective in the weighing process is removed by the defective item removing means at the portion downstream the weighing stage of the conveying passage. Just the non-defective items can thereby be selected and discharged from among the weighed objects.

During the discharging of a weighed object that is a defective item (may be referred to hereinafter as "defective weighed object") from the discharging chute, the opening/closing lid is rotated to the defective item outlet opening side by the lid rotating means and the defective weighed object is placed into the defective item outlet. A weighed object that is judged to be defective by weighing can thereby be removed reliably from the conveying passage by a simple and inexpensive structure.

Also, because the conveying passage having the weighing load cell is incorporated in a housing and arranged as a unit, not just a new weighed object manufacturing apparatus but even an existing weighed object manufacturing apparatus can be modified simply to a weighed object manufacturing apparatus that exhibits the effects of the present invention.

As the lid rotating means, for example, a rotary solenoid may be employed. In this case, a rotating rod of the rotary solenoid is rotated within a vertical plane to make the opening/closing lid open and close the defective item outlet within the vertical plane. An electrical motor may be used in place of the rotary solenoid.

A weighing machine according to a sixth claim of the present invention is a weighing machine according to the fifth claim that a defective item recovery box, containing weighed objects that are defective items, is disposed immediately below the defective item outlet, and to the opening/closing lid is fixed a discharging guide that contacts each defective weighed object that is a discharged from the defective item outlet and guides the defective weighed object into the defective item recovery box.

With the invention according to the sixth claim, when the opening/closing lid rotates to the defective item outlet opening side and the defective item outlet opens, the defective weighed object, discharged from the discharging chute, drops down so as to follow a parabolic curve from the defective item outlet. In this process, the defective weighed object contacts the discharging guide of the opening/closing lid and is thereafter guided by the discharging guide and becomes housed in the defective item recovery box. A defective weighed object that is discharged from the defective item outlet can thereby be loaded reliably into the defective item recovery box by a simple and inexpensive structure that does not use a conveyor, etc.

The material, shape, and size of the defective item recovery box are not restricted.

Here, "immediately below the defective item outlet" shall refer not just to a portion immediately below the defective item outlet but shall refer inclusively to portions in a nearby region as well.

The discharging guide may be formed integral to or as a separate member from the opening/closing lid. However, the opening/closing lid and the discharging guide must be in a fixed state. That is, in accompaniment with the rotation of the opening/closing lid, the discharging guide always rotates by the same angle and defines the direction of dropping of a defective weighed object.

A weighing machine according to a seventh claim of the present invention is a weighing machine according to the sixth claim that further has a rotation angle adjusting means that adjusts angles of rotation of the opening/closing lid and the discharging guide by the lid rotating means to change the position of dropping of the defective weighed object.

With the invention according to the seventh claim, the rotation angles of the opening/closing lid and the discharging guide in the lid opening process are adjusted, based on a weighing signal from the weighing load cell, by the rotation angle adjusting means. The position of dropping of a weighed object that is guided by the discharging guide is thereby changed to enable the position of recovery of the weighed object to be changed according to defect conditions, such as overweight and underweight. Defective weighed objects that differ in defect conditions can thus be recovered separately in a plurality of defective item recovery boxes.

Also, the rotation angle adjusting means may be used to change the lid opening angle of the opening/closing lid by a small angle at a time each time a defective weighed object is detected. By doing so, defective weighed objects are prevented from dropping in a biased manner onto a single location inside the defective item recovery box and the defective weighed objects can be dropped substantially uniformly across the entire range of the interior of the defective item recovery box. Collapsing to the exterior of the box, etc., of defective weighed objects, which become heaped despite there being an allowance in the containment space in an upper portion of the box, can thereby be prevented. The amount of defective weighed objects that can be recovered in the defective item recovery box without using manpower can also be increased.

Here, the rotation angle of the opening/closing lid is made variable. However, it shall be deemed that at least in the lid opening process of the opening/closing lid, an angle that enables the passage of a defective weighed object through the defective item outlet is secured at all times.

EFFECT(S) OF THE INVENTION

With the invention according to the first claim, because the packaging weighing stage is incorporated inside the packaging machine, the equipment cost is made inexpensive, the installation space is made small, the time from the manufacture of the packaging to the end of weighing can be shortened, and the productivity can be improved.

With the invention of the second claim, because the weighing means has the weighing bucket, which receives the packaging, and the weighing load cell, which is connected to the weighing bucket, the packaging can be weighed reliably at high precision.

With the invention of the third claim, a packaging that is judged to be defective in the weighing process is removed by the defective item removing means at the portion downstream the weighing stage of the packaging discharging unit. Just the non-defective items can thereby be selected and discharged from the packaging discharging unit.

In the middle of discharging the defective packaging from the discharging chute, the opening/closing lid is rotated to the defective item outlet opening side by the lid rotating means and the defective packaging is placed into the defective item outlet. A packaging that is judged to be defective by weighing can thereby be removed reliably from the packaging discharging unit by a simple and inexpensive structure.

Also, because the packaging discharging unit having the weighing means is arranged as a unit, not just a new packaging machine but even an existing packaging machine can be modified easily to a packaging machine that exhibits the effects of the present invention.

With the invention according to the fourth claim, because the weighed object is weighed by the weighing means inside the housing, when, for example, the weighing machine is positioned near a product outlet of an apparatus that manufactures the weighed object, a belt conveyor or other transferring apparatus that transfers the weighed object to the weighing stage as in the conventional case is made unnecessary. The equipment cost is thus made inexpensive, the installation space used by the entirety of the equipment that manufactures the weighed object is made small, the time required for the weighed object to pass the weighing inspection and become a product is shortened, and the productivity can be improved.

Also, because the weighing means has the weighing bucket, which receives the packaging, and the weighing load cell, which is connected to the weighing bucket, the packaging can be weighed reliably at high precision.

With the invention according to the fifth claim, a weighed object that is judged to be defective in the weighing process is removed by the defective item removing means at the portion downstream the weighing stage of the conveying passage. Just the non-defective items can thereby be selected and discharged from among the weighed objects.

In the middle of discharging the weighed object that is a defective item from the discharging chute, the opening/closing lid is rotated to the defective item outlet opening side by the lid rotating means and the defective weighed object is placed into the defective item outlet. A weighed object that is judged to be defective by weighing can thereby be removed reliably from the conveying passage by a simple and inexpensive structure.

With the invention according to the sixth claim, a defective weighed object, discharged from the discharging chute, drops down so as to follow a parabolic curve from the defective item outlet. In this process, the defective weighed object contacts the discharging guide of the opening/closing lid and is thereafter guided by the discharging guide and becomes housed in the defective item recovery box. A defective weighed object that is discharged from the defective item outlet can thereby be loaded reliably into the defective item recovery box by a simple and inexpensive structure that does not use a conveyor, etc.

With the invention according to the seventh claim, the rotation angle of the opening/closing lid and the discharging guide in the lid opening process is adjusted, based on a weighing signal from the weighing load cell, by the rotation angle adjusting means. The position of dropping of a weighed object that is guided by the discharging guide is thereby changed to enable the position of recovery of the weighed object to be changed according to defect conditions, such as overweight and underweight. Defective weighed objects that differ in defect conditions can thus be recovered separately in a plurality of defective item recovery boxes.

BRIEF DESCRIPTION OF THE DRAWINGS

FIG. 4(*b*) is an enlarged longitudinal sectional view of the weighing means of the packaging machine according to Embodiment 1 of the present invention in a defective item discharging process;

DESCRIPTION OF THE SYMBOLS

Figure 1:
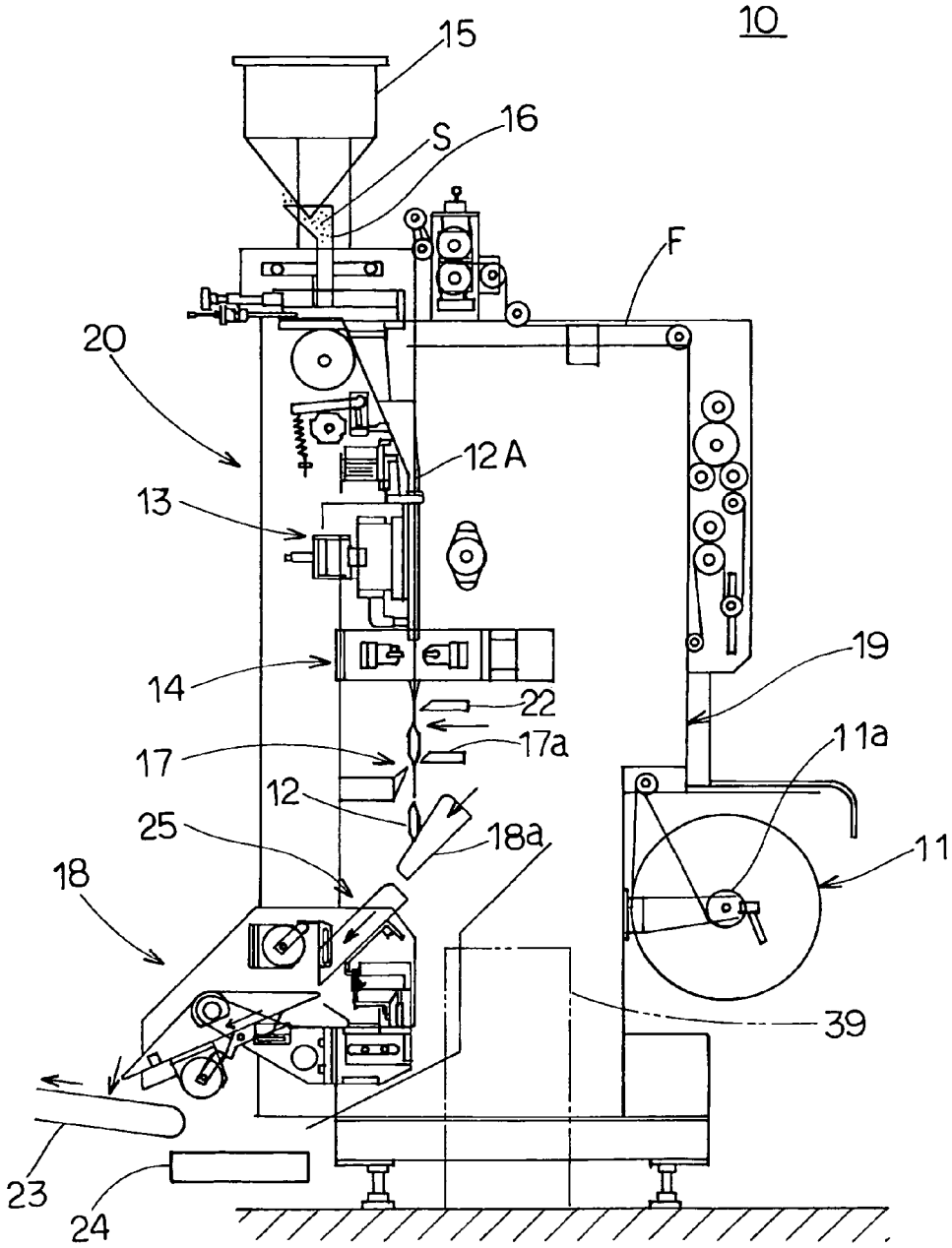
FIG. 1 is a side view of a packaging machine according to Embodiment 1 of the present invention.

10 stick packaging machine (packaging machine)
12 stick packaging (weighed object)
12A pre-packaging body
12B defective stick packaging (defective packaging)
18 stick discharging unit (packaging discharging unit)
24, 69 defective item recovery box
25, 53 weighing means
26, 51 housing
31, 59 weighing load cell
31*a*, 63*a* defective item outlet
35, 67 opening/closing lid
36, 68 second rotary solenoid (lid rotating means)
37, 74 non-defective item counter
38, 63 discharging chute
52 conveying passage
55 weighing bucket
70 discharging guide
80 rotation angle adjusting means
F packaging sheet

BEST MODES FOR CARRYING OUT THE INVENTION

Embodiments of the present invention shall be referenced and described below.

Embodiment 1

First, a stick packaging machine of Embodiment 1 shall be described with reference to FIG. 1 to FIG. 5. Here, a quadruple stick packaging machine (packaging machine) that can simultaneously manufacture four stick packagings (packagings/weighed objects) that are sugar sticks shall be described as an example.

In FIG. 1, 10 indicates a stick packaging machine according to Embodiment 1 of the present invention, and this stick packaging machine 10 includes four supplying units 11 that supply four laminated packaging sheets F simultaneously, four longitudinal seal forming units 13, each sealing a longitudinal sealed portion 12*a* (FIG. 5), formed by bringing together both ends (both longitudinal edges) in a width direction of a packaging sheet F, and folding the packaging sheet F to a cylindrical form, four lateral seal forming units 14, each forming lateral sealed portions 12*b* (FIG. 5) at both an upper end and a lower end of a pre-packaging body 12A in the middle of manufacture, four hoppers (contents storing units) 15, each storing sugar (contents) S provided from above and dropping a predetermined amount of sugar S in a continuous manner, four contents supplying units 16, each supplying sugar S, supplied from hoper 15, to the pre-packaging body 12A, four lateral seal cutting units 17, each cutting respective lateral sealed portions 12*b* by a cutter 17*a*, four stick discharging units (packaging discharging units) 18, each discharging a stick packaging 12 (FIG. 5), discharged from a corresponding lateral seal cutting unit 17, out of the stick packaging machine 10, and a main apparatus body 19 in which the above components are installed.

Each stick packaging mechanism 20, having a supplying unit 11, a longitudinal seal forming unit 13, a lateral seal forming unit 14, a hopper 15, a contents supplying unit 16, a lateral seal cutting unit 17, and a stick discharging unit 18, has the same structure, and the respective stick packaging mechanisms 20 are aligned in parallel in horizontal states in the main apparatus body 19. Thus, the following description shall concern just a single stick packaging mechanism 20.

The stick packaging machine 10 shall now be described in detail.

The main apparatus body 19 is a vertically long, rectangular parallelepiped casing, and the supplying unit 11, which supplies the laminated packaging sheet F, wound around a reel 11*a*, is disposed at a lower portion at a rear side (back side) of the main apparatus body 19. The hopper 15, which loads sugar S into the pre-packaging body 12A that is in the state of being unsealed at an upper portion, is erected on an upper face at a front side of the main apparatus body 19. The contents supplying unit 16, which shapes the packaging sheet F into cylindrical form, is disposed at an upper end portion at the front side of the main apparatus body 19. The longitudinal seal forming unit 13, which adheres together both end portions in the width direction of the cylindrical packaging sheet F and thereby forms a backlining portion 12*a*, is disposed at an upper portion at the front side of the main apparatus body 19.

The lateral seal forming unit 14, which seals the cylindrical packaging sheet F in a direction orthogonal to a length direction of the packaging sheet F at a predetermined pitch in the length direction and thereby forms lateral sealed portions 12*b*, is disposed at a central portion of the front side of the main apparatus body 19. A cutter 22, which forms a notch at an end portion at one of the lateral edges, is disposed immediately below the lateral seal forming unit 14 at the front side of the main apparatus body 19. Lateral seal cutting unit 17, which cuts lateral sealed portions 12*b* to form the stick packaging 12, is disposed immediately below cutter 22.

The stick discharging unit 18 is disposed at a lower portion of the front side of the main apparatus body 19. An introducing chute 18*a*, which feeds each manufactured the stick packaging 12 into the stick discharging unit 18, is disposed immediately below lateral seal cutting unit 17. Also, a belt conveyor 23, which conveys out each stick packaging 12, discharged from the stick discharging unit 18, is disposed near a lower end portion of the front side of the main apparatus body 19. Furthermore, a defective item recovery box 24, which recovers defective stick packagings (defective packagings) 12B that are judged to be defective in a weighing process, is positioned on a floor surface below the stick discharging unit 18. A weighing means 25, which weighs each manufactured the stick packaging 12, is disposed in the stick discharging unit 18.

The stick discharging unit 18 shall now be described in detail with reference to FIG. 2 to FIG. 4.

Figure 2:
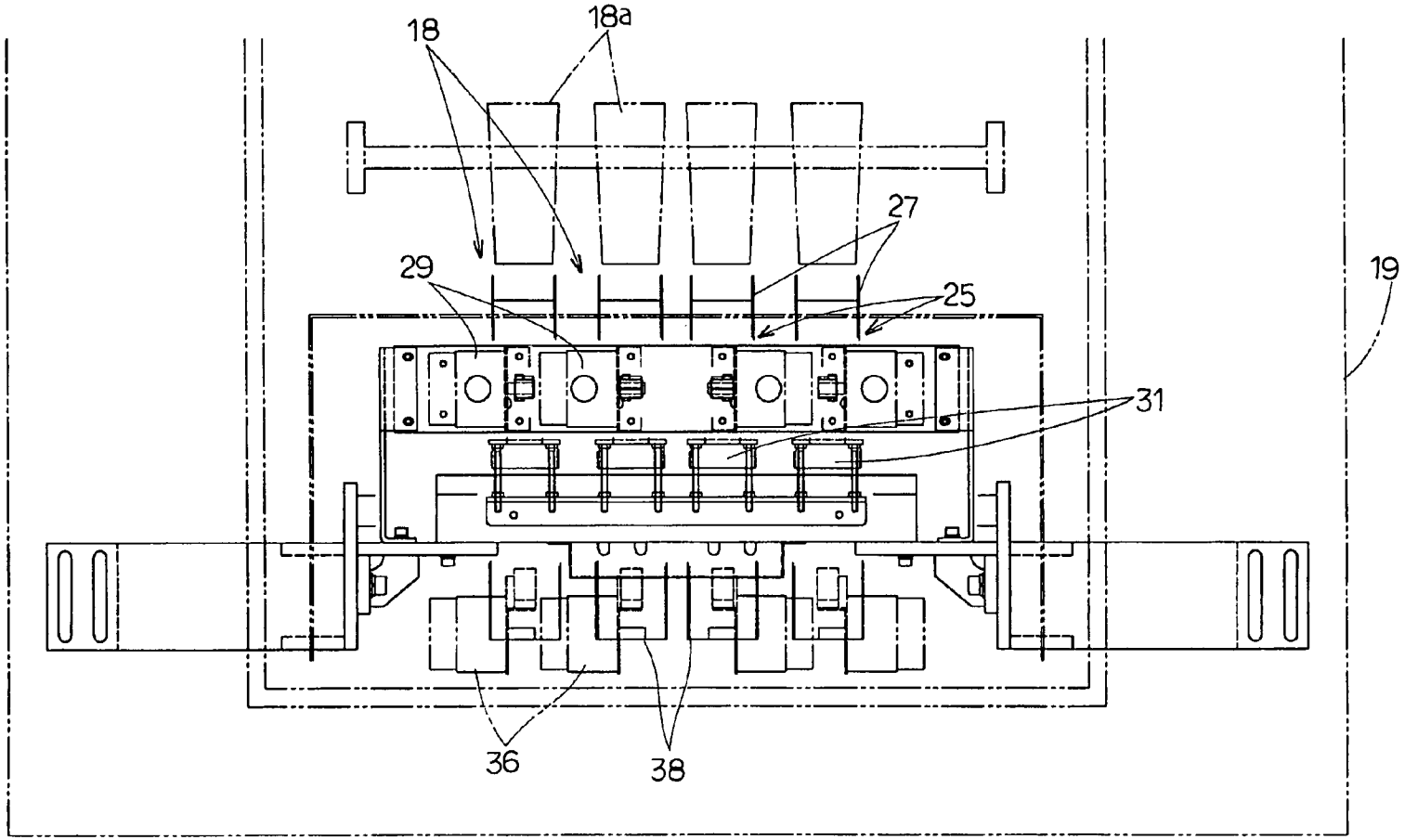
FIG. 2 is an enlarged front view of a weighing means of the packaging machine according to Embodiment 1 of the present invention.
Figure 3:
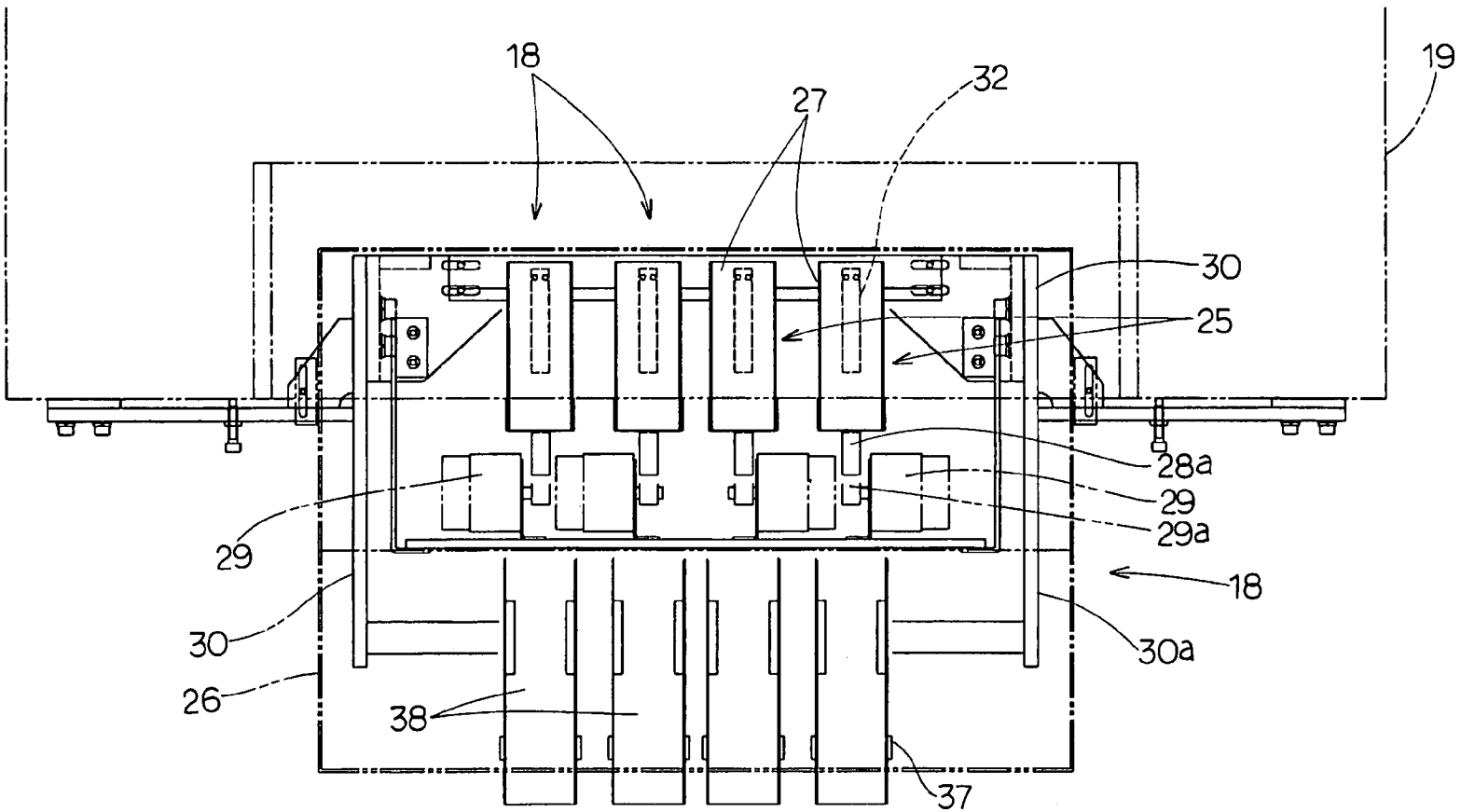
FIG. 3 is an enlarged plan view of the weighing means of the packaging machine according to Embodiment 1 of the present invention.
Figure 4A:
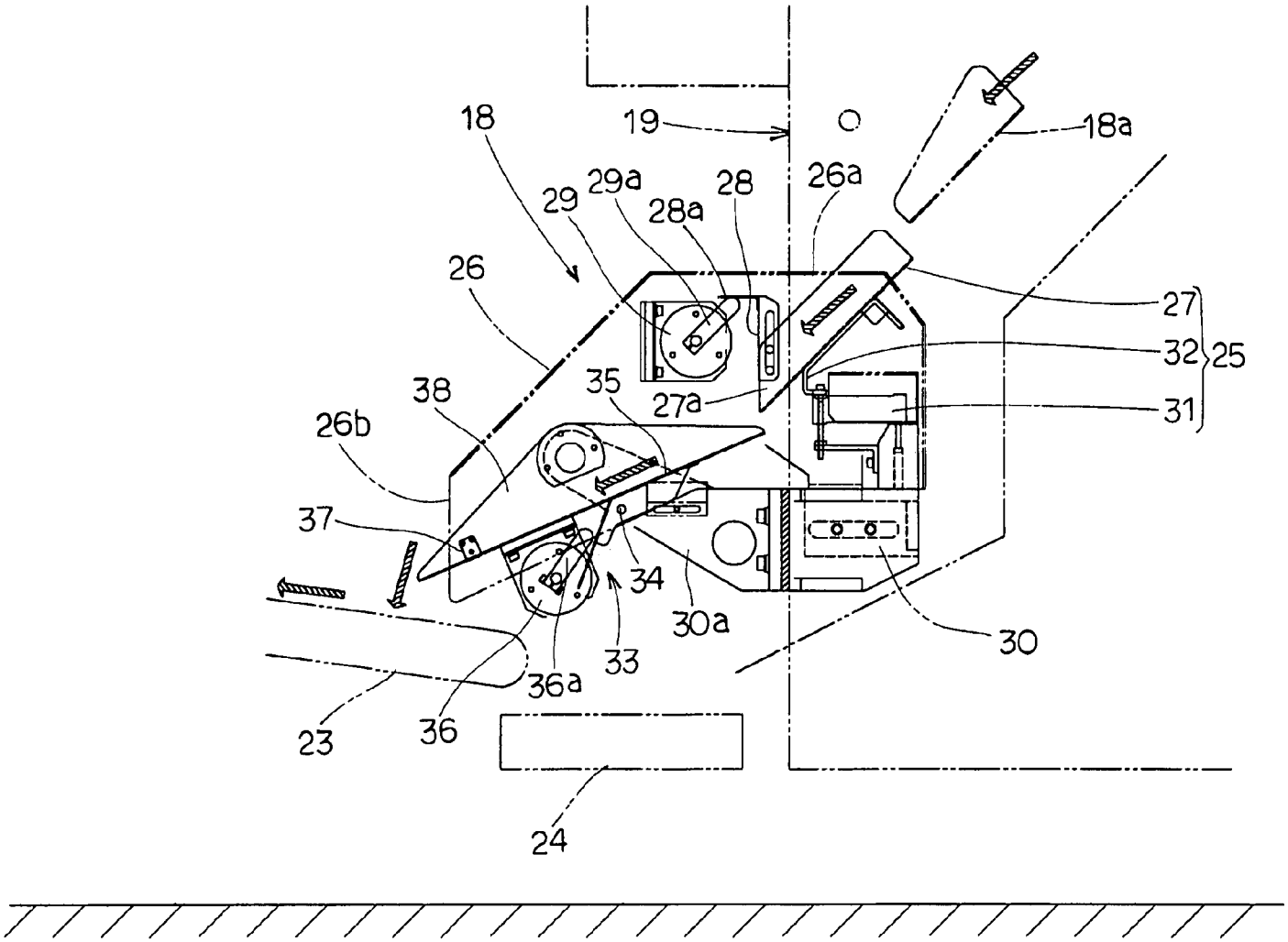
FIG. 4(*a*) is an enlarged longitudinal sectional view of the weighing means of the packaging machine according to Embodiment 1 of the present invention in a non-defective item discharging process.
Figure 4B:
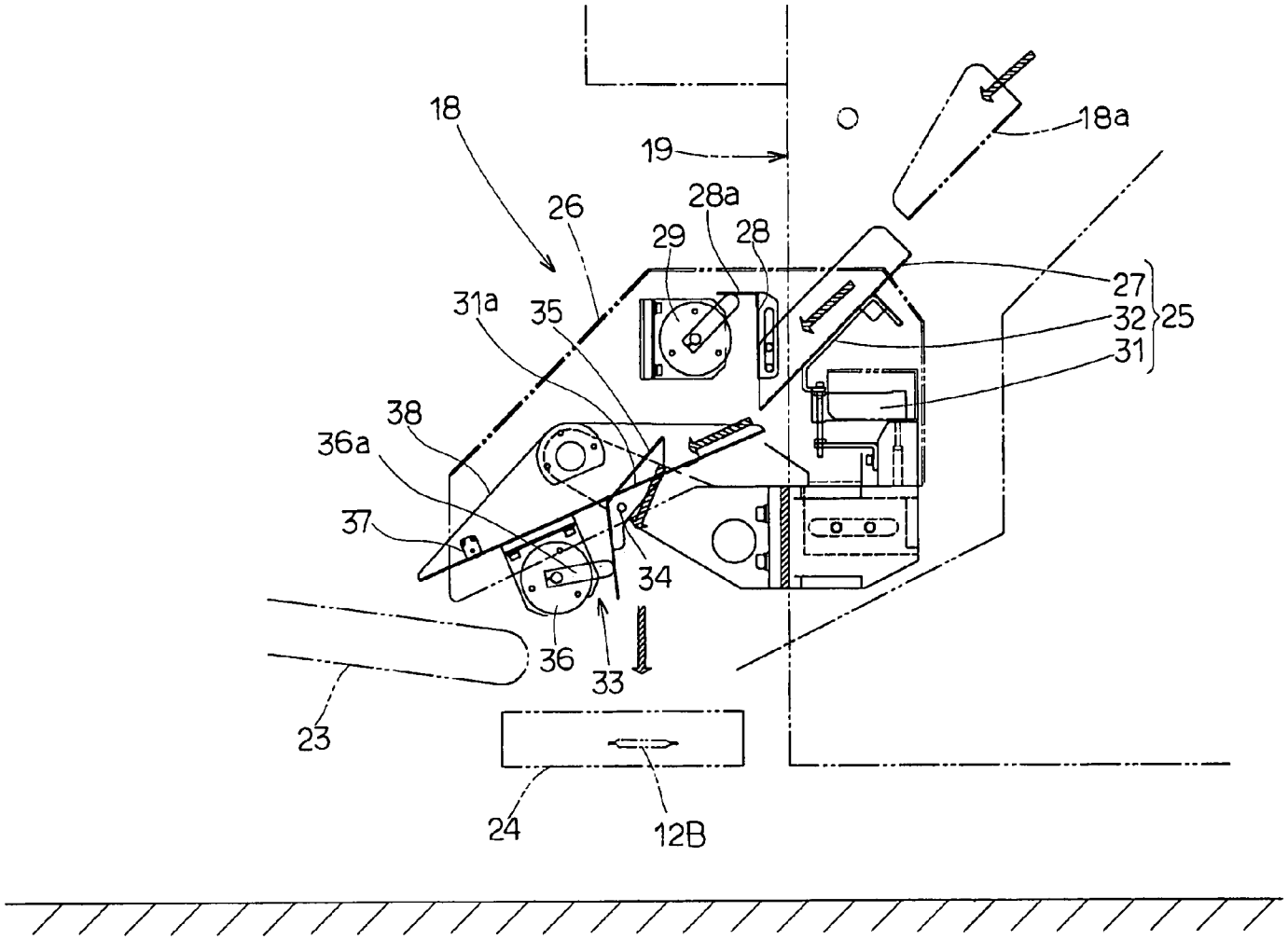
Figure 5:
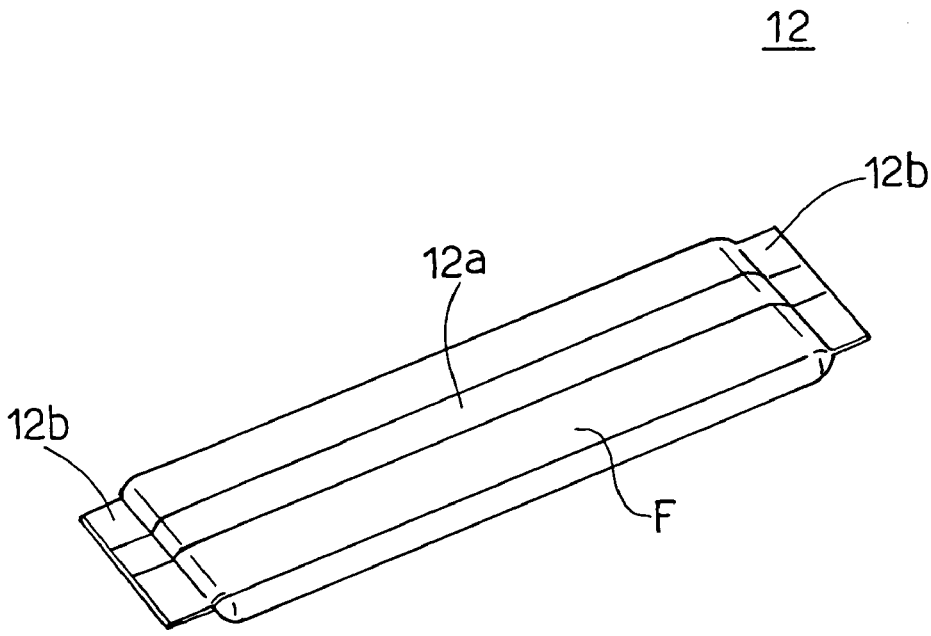
FIG. 5 is a perspective view of a packaging manufactured by the packaging machine according to Embodiment 1 of the present invention.

As shown in FIG. 2 to FIG. 4, the stick discharging unit 18 has, as a main body, a housing 26, having an inlet 26*a* for the stick packaging 12 formed at an upper side and having an outlet 26*b* for the stick packaging 12 formed at a lower corner portion at a front side. The housing 26 houses four stick packaging mechanisms 20 together. At inlet 26*a* in the housing 26 is housed a weighing bucket 27, which receives the stick packaging 12 discharged from the introducing chute 18*a* and has an outlet 27*a* formed at a lower end portion. A region of the stick packaging machine 10 at which the weighing bucket 27 is positioned is a weighing stage.

The weighing bucket 27 is a chute-shaped bucket that is inclined with its outlet 27*a* directed downward. A vertically-sliding opening/closing door 28 is mounted to the outlet 27*a*, and an ascending/descending lever 28*a* protrudes from an upper end portion of the opening/closing door 28. A first rotary solenoid 29, which rotates a rotating rod 29*a* within a vertical plane to raise and lower the opening/closing door 28, is fixed at a portion of the housing 26 near the opening/closing door 28.

A fixed base portion 30, which fixes the housing 26 to the main apparatus body 19, is disposed at a portion of the housing 26 immediately below the weighing bucket 27. A weighing load cell 31 is fixed onto the fixed base portion 30. The weighing bucket 27 is connected via a bracket 32 of a substantially V-like shape in side view to a probe of the weighing load cell 31. When the stick packaging 12 is loaded into the weighing bucket 27, the stick packaging 12 is weighed by the weighing load cell 31 via bracket 32. After weighing, the rotating rod 29*a* of the first rotary solenoid 29 is rotated within the vertical plane to a door opening side. The opening/closing door 28 is thereby raised via the ascending/descending lever 28*a* and the stick packaging 12 is discharged from the weighing bucket 27 toward the outlet 26*b* of the housing 26.

Between the weighing bucket 27 and outlet 26*b* of the housing 26 is housed a discharging chute 38, with which an end portion at the outlet 26*b* side is inclined downward. The discharging chute 38 has an isosceles triangular shape in side view. A defective item outlet 31*a* is formed near an intermediate portion in a length direction of the discharging chute 38. At both sides of a face of the fixed base portion 30 at the discharging side are disposed base portions of a pair of arms 30*a*, with each of which a front end portion is fixed to an obtuse angle portion of the discharging chute 38. The discharging chute 38 is provided with a defective item removing means 33 that removes each defective stick packaging 12B judged to be outside a weight range of non-defective items by weighing.

Specifically, an opening/closing lid 35, having a substantially inverted-V-like shape in side view, being axially supported via a rotating pin 34 on the portion of the discharging chute 38 at which the defective item outlet 31*a* is formed, and the opening and closing the defective item outlet 31*a* by rotating within a vertical plane, and a second rotary solenoid (lid rotating means) 36, rotating the opening/closing lid 35 via a rotating rod 36*a*, are provided. The second rotary solenoid 36 is fixed to a back face of an end portion at the outlet 26*b* side of the discharging chute 38. Also, at an end portion at the discharging side of the discharging chute 38 is provided a non-defective item counter 37 that counts the number of the non-defective stick packagings 12 that have passed through the discharging chute 38.

The above-mentioned defective item recovery box 24 is positioned immediately below the defective item outlet 31*a*. The stick discharging unit 18 is arranged as a unit by the housing the weighing bucket 27, the weighing load cell 31, the first rotary solenoid 29, the second rotary solenoid 36, the discharging chute 38, the opening/closing lid 35, and the non-defective item counter 37 in the housing 26. The weighing means 25 is arranged from the weighing bucket 27, the weighing load cell 31, and bracket 32.

In FIG. 1, 39 is a control panel of the stick packaging machine 10.

Actions of the stick packaging machine 10 according to Embodiment 1 of the present invention shall now be described with reference to FIG. 1 to FIG. 5.

First, the packaging sheet F is lead out from reel 11*a* by means of the supplying unit 11. The packaging sheet F is then shaped to a cylindrical shape by using the contents supplying unit 16, and both ends in the width direction of the cylindrical packaging sheet F are adhered together by means of the longitudinal seal forming unit 13 to form longitudinal sealed portion 12*a*. The cylindrical packaging sheet F is then heat-sealed at a predetermined pitch in the length direction by means of the lateral seal forming unit 14 to form one of lateral sealed portions 12*b*. Sugar S, inside the hopper 15, is then dropped and filled into the pre-packaging body 12A in the state of being unsealed at the upper portion. The upper end portion of the pre-packaging body 12A is then sealed by means of the lateral seal forming unit 14, and a notch (cut) is formed in one of the lateral edges by means of cutter 22. By then successively cutting lateral sealed portions 12*b* by means of lateral seal cutting unit 17, stick packagings 12 are manufactured continuously.

Each manufactured the stick packaging 12 is loaded into the weighing bucket 27 from the introducing chute 18*a*. The stick packaging 12 is weighed by means of the weighing load cell 31 here. After weighing, the opening/closing door 28 is raised by means of the first rotary solenoid 29, and the stick packaging 12 is discharged from the weighing bucket 27. The stick packaging 12 is consequently discharged out of the machine through the discharging chute 38 and from outlet 26*b* of the housing 26 (FIG. 4(*a*)).

However, a defective stick packaging 12B, which is judged, in the weighing process, to be lighter or heavier than anon-defective item weight set in advance, is dropped, in the middle of passing through the discharging chute 38, from the defective item outlet 31*a*, opened by the rotating of the opening/closing lid 35 by the second rotary solenoid 36, and is loaded into the above-mentioned defective item recovery box 24 immediately below (FIG. 4(*b*)).

The non-defective stick packagings 12 that have been discharged out of the machine are successively transferred to a subsequent packing process by means of the above-mentioned belt conveyor 23.

As described above, since the weighing means 25 for the stick packaging 12 is disposed inside the stick packaging machine 10, the equipment cost is made inexpensive, the installation space is made small, and the time required from the manufacture to the end of weighing of the stick packaging 12 is shortened, thereby enabling the productivity to be improved.

Also, because the weighing means 25 has the weighing bucket 27, which receives the stick packaging 12, and the weighing load cell 31, which is connected to the weighing bucket 27, the stick packaging 12 can be weighed reliably at high precision.

A defective stick packaging 12B that is judged to be defective in the weighing process is removed by means of defective item removing means 33 at a portion downstream the weighing stage of the stick discharging unit 18. Just non-defective items can thereby be selected and discharged from the stick discharging unit 18.

Furthermore, in the middle of passing through the discharging chute 38, the defective stick packaging 12B is discharged from the defective item outlet 31*a*, which is opened by the rotating of the opening/closing lid 35 by the second rotary solenoid 36. Thus, even though the structure is simple and inexpensive, a stick packaging 12 that is judged to be defective by weighing can be removed reliably from the stick discharging unit 18.

Yet furthermore, the stick discharging unit 18, having the weighing means 25, is arranged as a unit in Embodiment 1. Thus, not just a new stick packaging machine 10 but even an existing stick packaging machine can be modified readily to a stick packaging machine that exhibits the effects of the present invention.

A weighing machine according to Embodiment 2 of the present invention shall now be described with reference to FIG. 6 to FIG. 9.

In FIG. 6 to FIG. 9, 50 is a weighing machine according to Embodiment 2 of the present invention, and this weighing machine 50 is an apparatus that can simultaneously weigh stick packagings 12 discharged from an existing, septuple type stick packaging machine (not shown), which can simultaneously manufacture seven stick packagings (objects to be weighed) 12.

Weighing machine 50 includes a housing 51, a conveying passage 52 that conveying stick packagings 12 housed in the housing 51, and a weighing means 53 that is disposed on the conveying passage 52 and measures the weights of stick packagings 12.

The housing 51 is a main body of weighing machine 50 and has an inlet 51*a* for the stick packaging 12 formed on an upper side and an outlet 51*b* for the stick packaging 12 formed on a lower corner portion at a front side. Inside the housing 51, seven weighing mechanisms 54, corresponding to seven introducing chutes of the unillustrated, existing stick packaging machine, are housed together. All weighing mechanisms 54 have the same structure. For the convenience of description, just one weighing mechanism 54 shall now be described in detail for Embodiment 2.

A weighing bucket 55, which receives the stick packaging 12 discharged from the existing stick packaging machine, is disposed at inlet 51*a* of the housing 51. Of the stick packaging machine 10, a region in which the weighing bucket 55 is disposed is a weighing stage. The outlet 55*a* for the stick packaging 12 is formed at a lower end portion (downstream portion) of the weighing bucket 55. The weighing bucket 55 is a chute-shaped bucket that is inclined with its outlet 55*a* directed downward. A portion from an upper face of a downstream half of the weighing bucket 55 to the outlet 55*a* is covered in a manner enabling opening and closing by an opening/closing door 56 that can rotate within a vertical plane.

The opening/closing door 56 is formed of a flat plate that is long in a machine length direction (left/right direction of weighing machine 50) and has its front portion bent downward by 45° and has its base portion bent upward by substantially 80°. A hinge portion is formed near the bent portion at the base side of the opening/closing door 56. The hinge portion is centered about a rotating shaft 56*a* that is spanned across side plates at both sides of a gate-shaped bracket 60 to be described later. The center of gravity of the opening/closing door 56 is positioned to the front side (outlet side) of the hinge portion. The opening/closing door 56 thus normally closes the outlet 55*a* of the weighing bucket 55 by its own weight.

A bracket 57, which is long in the machine length direction of weighing machine 50, is protruded form an inner face at a position of intermediate height of a rear plate (back plate) of the housing 51. A weighing load cell 59, having a probe directed towards the inner side of the housing 51, is fixed via a fixing base portion 58 to bracket 57. Lower end portions of a bottom plate of the gate-shaped bracket 60 are fixed to the probe, and the weighing bucket 55 is positioned in an internal space of the gate-shaped bracket 60.

A first rotary solenoid 62 is suspended via bracket 61 from an inner face of an intermediate portion in a machine width direction (front/rear direction) of an upper plate of the housing 51. When a rotating rod 62*a* of the first rotary solenoid 62 is rotated towards a door opening side within a vertical plane, the base portion of the opening/closing door 56 is pushed towards the outer side of the housing 51. The opening/closing door 56 is thereby rotated, about the rotating shaft 56*a* and within the vertical plane, to a door opening side. Consequently, the outlet 55*a* of the weighing bucket 55 opens, and the stick packaging 12 is discharged toward the outlet 51*b* of the housing 51 from inside the measuring bucket 55.

Between the weighing bucket 55 and outlet 51*b* of the housing 51 is housed a discharging chute 63, with which an end portion at the outlet side is inclined downward. The discharging chute 63 has an isosceles triangular shape in side view. A fixed rod 64 is spanned across apex portions of side plates of equilateral triangular shape at both sides of the discharging chute 63. Respective ends of the fixed rod 64 are fixed between a pair of the brackets 65 that are disposed apart from each other on an inner face of a portion at an intermediate height of the front plate housing 51.

A defective item outlet 63*a* is formed from an upstream portion (upper portion) to a midstream portion (intermediate portion in the length direction) of the discharging chute 63. The discharging chute 63 is provided with a defective item removing means 66 that can open and close the defective item outlet 63*a* and removes, via the defective item outlet 63*a*, a defective stick packaging 12B judged to be outside a weigh range of non-defective items by weighing.

This arrangement shall now be described in detail. The defective item removing means 66 has an opening/closing lid 67 of substantially inverted-V-like shape in side view that opens and closes the defective item outlet 63*a* by rotating within a vertical plane, and a second rotary solenoid (lid rotating means) 68 that rotates the opening/closing lid 67 via a rotating rod 62*a*.

The opening/closing lid 67 is a flat plate that is bent to a sideways V-like shape in side view and is mainly made up of a bottom plate and a pair of side plates that are formed by bending both sides of the bottom plate perpendicularly. A downstream portion of the bottom plate is bent towards the inner side of the housing 51 by just substantially 120° with respect to an upstream portion of the bottom plate. This downstream portion of the bottom plate is a discharging guide 70 that guides each defective stick packaging 12B, discharged from the defective item outlet 63*a*, to the defective item recovery box 69. A guiding piece 71, which is long in a length direction of the discharging guide 70, is protruded from an intermediate portion in a width direction of an outer face of the discharging guide 70 (outer face of the housing 51). A slot 71*a*, which is long in a length direction of guiding piece 71, is formed in guiding piece 71. A roller 68*b*, which is axially supported by a front end portion of rotating rod 68*a* of the second rotary solenoid 68, is inserted in slot 71*a* in a manner enabling movement in a length direction of slot 71*a*.

A pair of unillustrated bearings are positioned apart from each other near the downstream portion of the portion in which the defective item outlet 63*a* of the discharging chute 63 is formed. Between the bearings, the opening/closing lid 67 is axially supported via a rotating pin 72, an axial direction of which is horizontal. The second rotary solenoid 68 is fixed to a rear face of an end at the outlet side of the discharging chute 63 via a bracket 73. Also, a non-defective item counter 74, which counts the number of the non-defective stick packagings 12 that have passed through the discharging chute 63, is disposed at an end portion at the discharging side of the discharging chute 63. The above-mentioned defective item recovery box 69 is positioned immediately below the defective item outlet 63*a*.

The stick discharging unit 18 is arranged as a unit by housing the weighing bucket 55, weighing load cell 59, first rotary solenoid 62, second rotary solenoid 68, discharging chute 63, opening/closing lid 67, and non-defective item counter 74 in the housing 51. The weighing means 53 is arranged from the weighing bucket 55 and the weighing load cell 59. The conveying passage 52 is arranged from the weighing bucket 55 and the discharging chute 63.

In FIG. 6, FIG. 8, and FIG. 9, 75 indicates supporting columns that are disposed at four corners of a bottom portion of the housing 51. Each supporting column has a bolt 75*a* as a main body and is arranged to be adjustable in height by a double nut structure 75*b*.

Actions of weighing machine 50 according to Embodiment 2 shall now be described with reference to FIG. 6 to FIG. 13.

Figure 6:
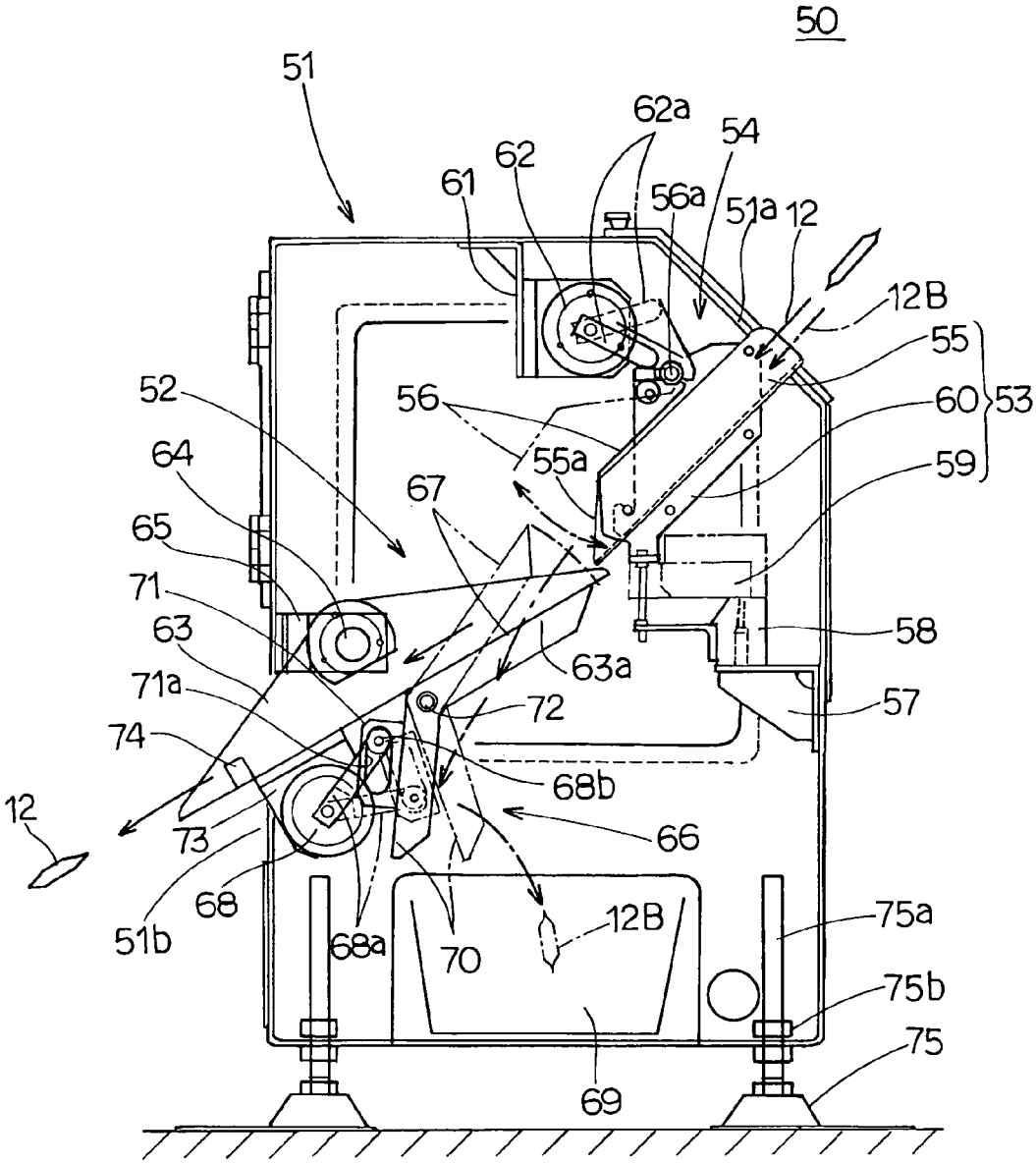
FIG. 6 is a longitudinal sectional view of a weighing machine according to Embodiment 2 of the present invention as viewed from a side.
Figure 7:
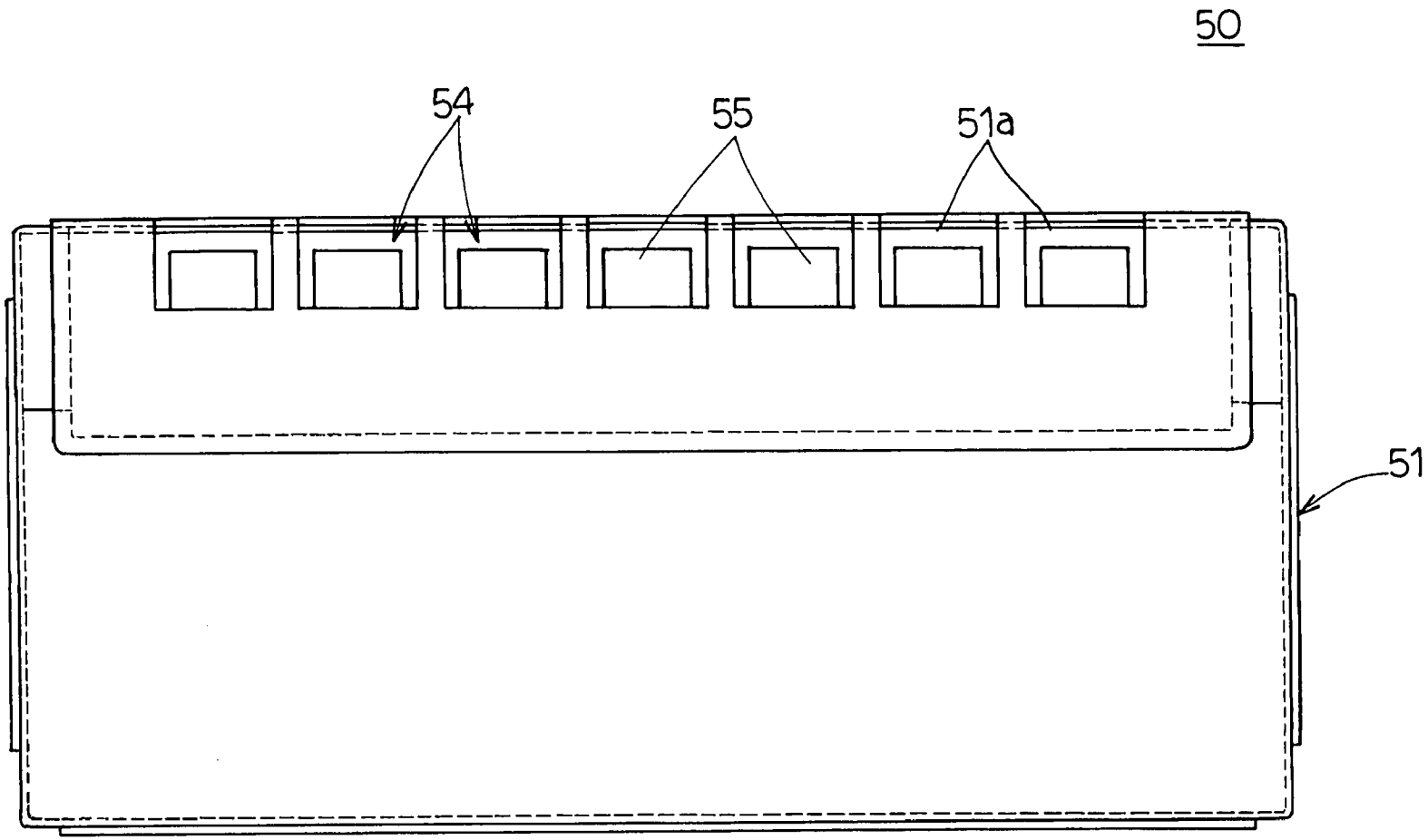
FIG. 7 is a plan view of the weighing machine according to Embodiment 2 of the present invention.
Figure 8:
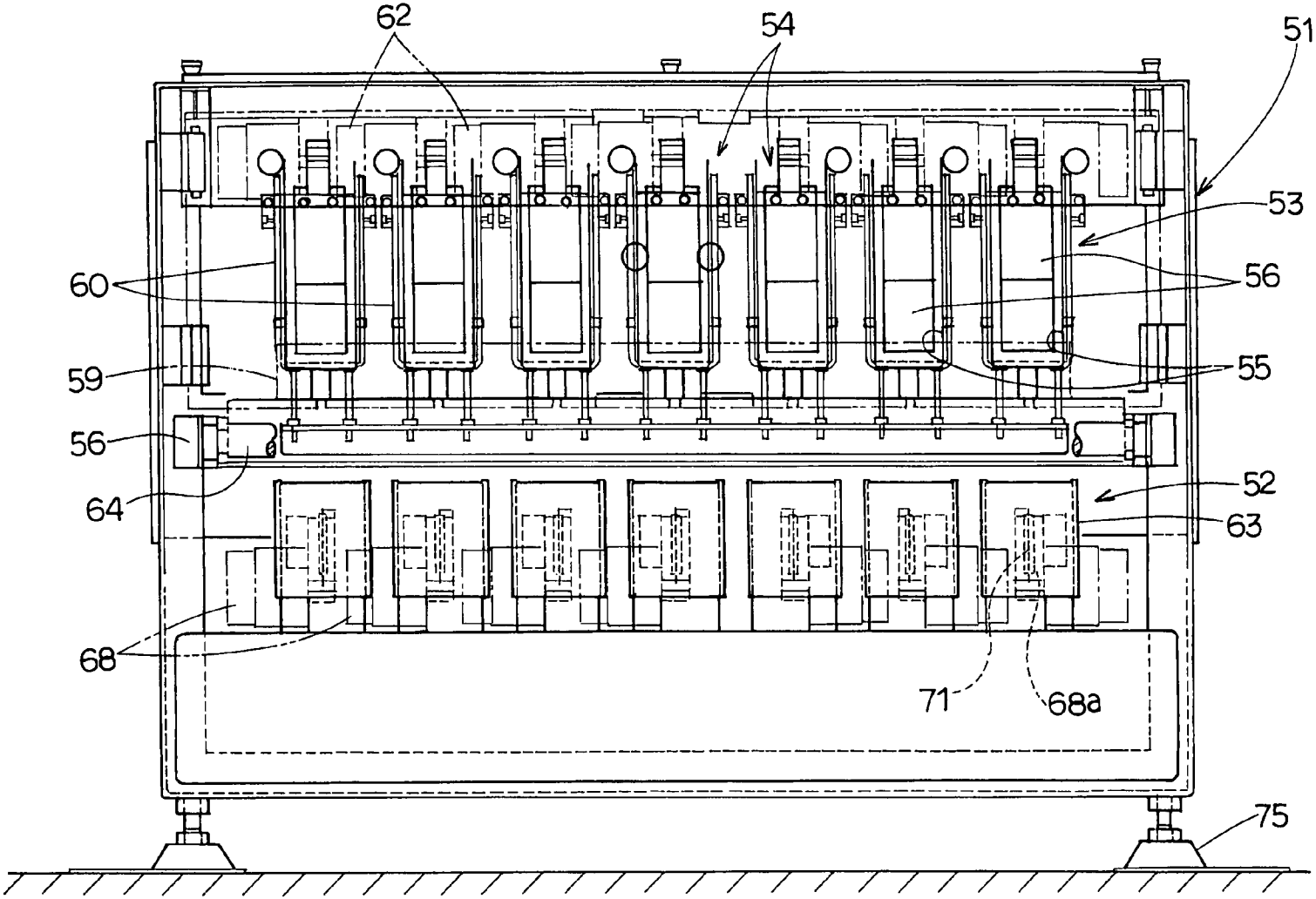
FIG. 8 is a front view of the weighing machine according to Embodiment 2 of the present invention.
Figure 9:
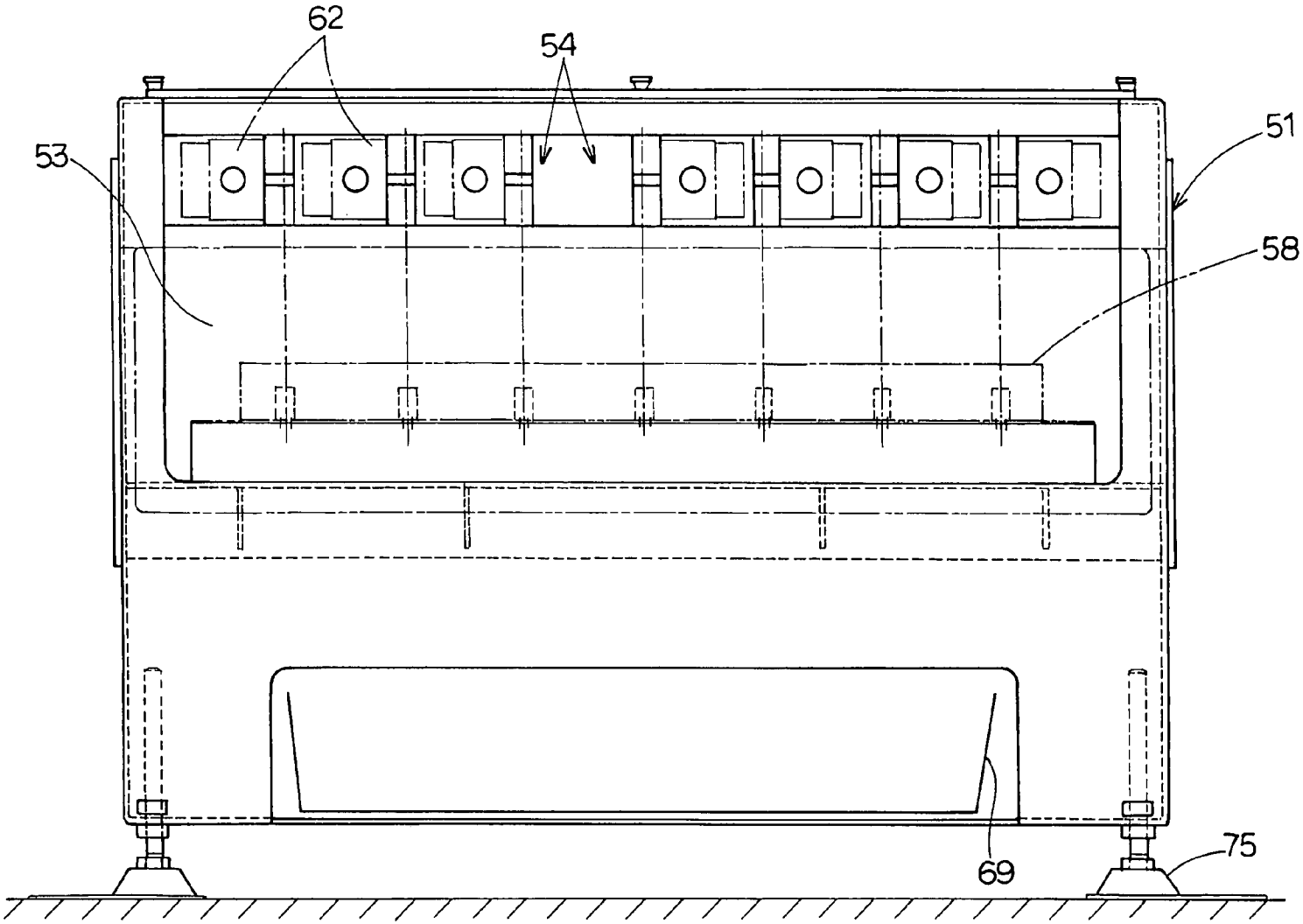
FIG. 9 is a rear view of the weighing machine according to Embodiment 2 of the present invention.
Figure 10:
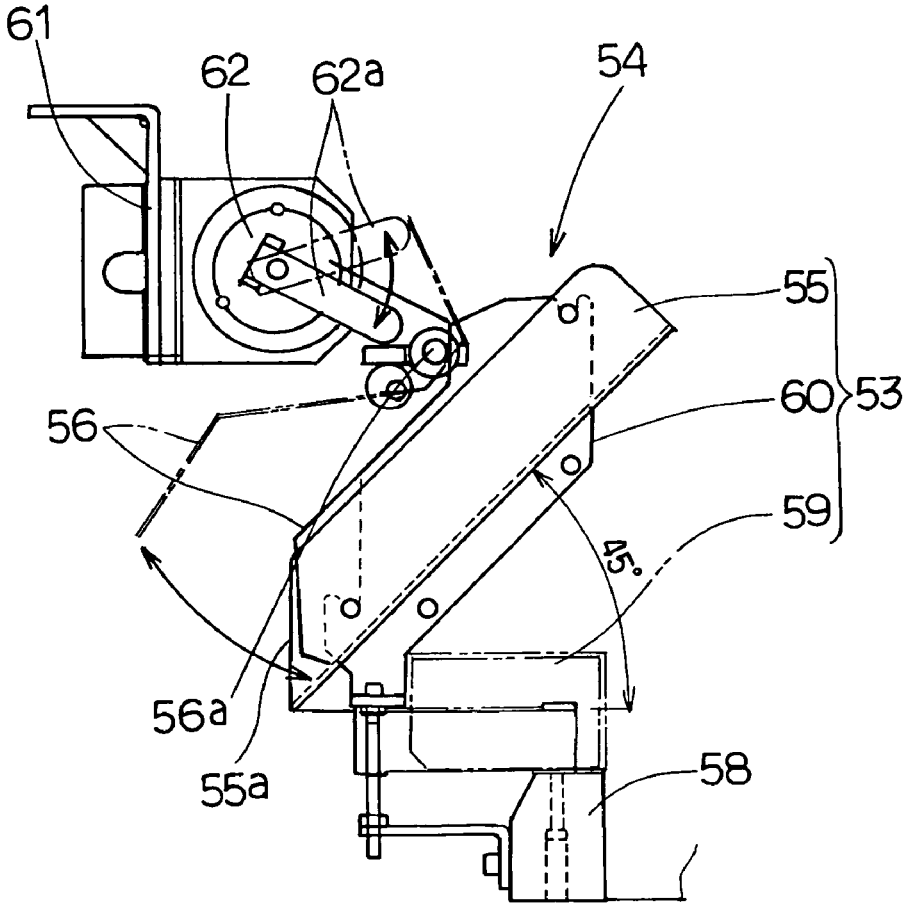
FIG. 10 is an enlarged side view of a weighing stage region of the weighing machine according to Embodiment 2 of the present invention.
Figure 11:
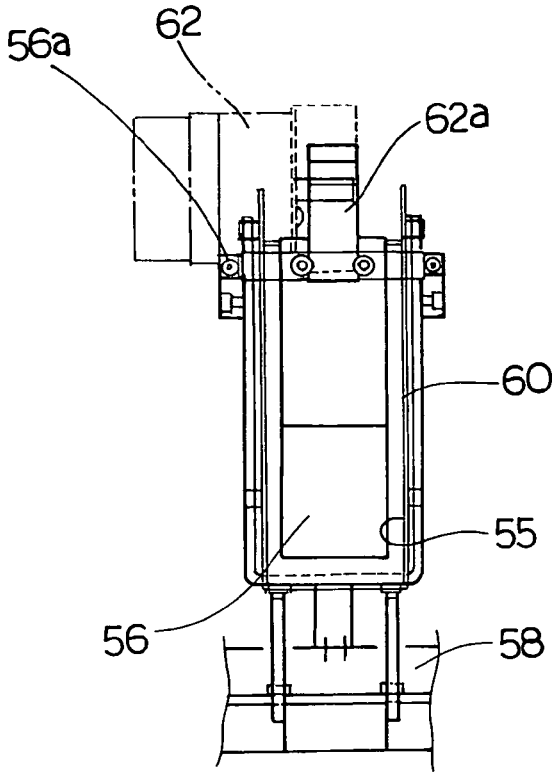
FIG. 11 is an enlarged front view of the weighing stage region of the weighing machine according to Embodiment 2 of the present invention.
Figure 12:
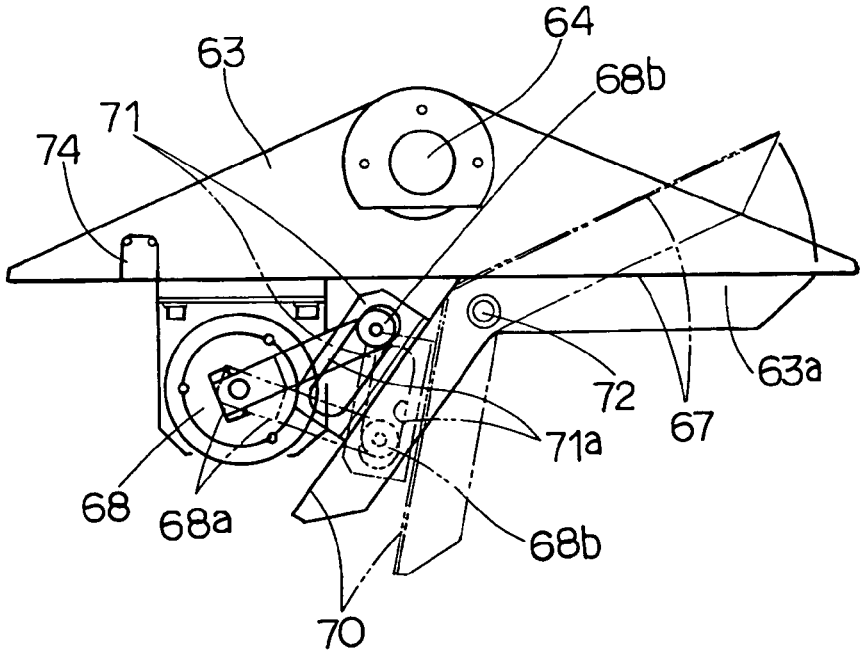
FIG. 12 is an enlarged side view of principal portions of a defective item discharging means of the weighing machine according to Embodiment 2 of the present invention.
Figure 13:
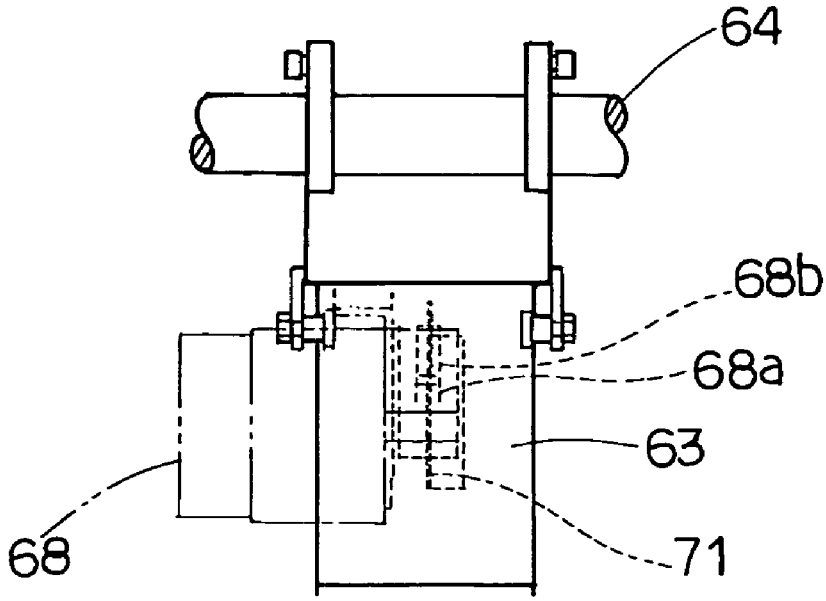
FIG. 13 is an enlarged front view of the principal portions of the defective item discharging means of the weighing machine according to Embodiment 2 of the present invention.

First, a stick packaging 12, discharged from the existing stick packaging machine, is loaded into the weighing bucket 55 from an unillustrated introducing chute. The stick packaging 12 is weighed by means of the weighing load cell 59 here. After weighing, the opening/closing door 56 is rotated within the vertical plane to the opening side (upward) by means of the first rotary solenoid 62, and the stick packaging 12 is discharged from the weighing bucket 55. The stick packaging 12 is consequently discharged out of the machine through the discharging chute 63 and from the outlet 51*b* of the housing 51 (FIG. 6).

However, a defective stick packaging 12B, which is judged, in the weighing process, to be lighter or heavier than anon-defective item weight set in advance, is dropped, in the middle of passing through the discharging chute 63, so as to follow a parabolic curve from the defective item outlet 63*a* by the rotating of the opening/closing lid 67 by the second rotary solenoid 68. In the middle of the dropping process, the defective stick packaging 12B contacts the discharging guide 70 and is thereafter guided by the discharging guide 70 and loaded into the defective item recovery box 69. The defective stick packaging 12B, discharged from defective item discharging port 63*a*, can thus be loaded reliably into the defective item recovery box 69 by means of a simple and inexpensive structure that does not use a belt conveyor, etc.

As described above, since the weighing means 53 is arranged to weigh the stick packaging 12 inside the housing 51, the stick packaging 12 does not have to be transferred by a belt conveyor, etc., to a weighing stage disposed far away from the stick packaging machine 10 as in the conventional case. As a result, the equipment cost is made inexpensive and the installation space used by the entirety of equipment for manufacturing the stick packaging 12 is made small. Moreover, the time required for the stick packaging 12 to pass the weighing inspection and become a product is shortened and the productivity can be improved.

Also, because the weighing means 53 has the weighing bucket 55, which receives the stick packaging 12, and the weighing load cell 59, which is connected to the weighing bucket 55, the stick packaging 12 can be weighed reliably at high precision.

Each defective stick packaging 12B is removed by means of defective item removing means 66 at a portion downstream the weighing stage of the conveying passage 52. Just non-defective items can thereby be selected and discharged from the conveying passage 52.

Furthermore, in the middle of passing through the discharging chute 63, the defective stick packaging 12B is discharged from the defective item outlet 63*a*, which is opened by the rotating of the opening/closing lid 67 by the second rotary solenoid 68, and is discharged into defective item recover box 69 immediately below. Thus, even though the structure is simple and inexpensive, a stick packaging 12 that is judged to be defective by weighing can be removed reliably from along the conveying passage 52.

Figure 14:
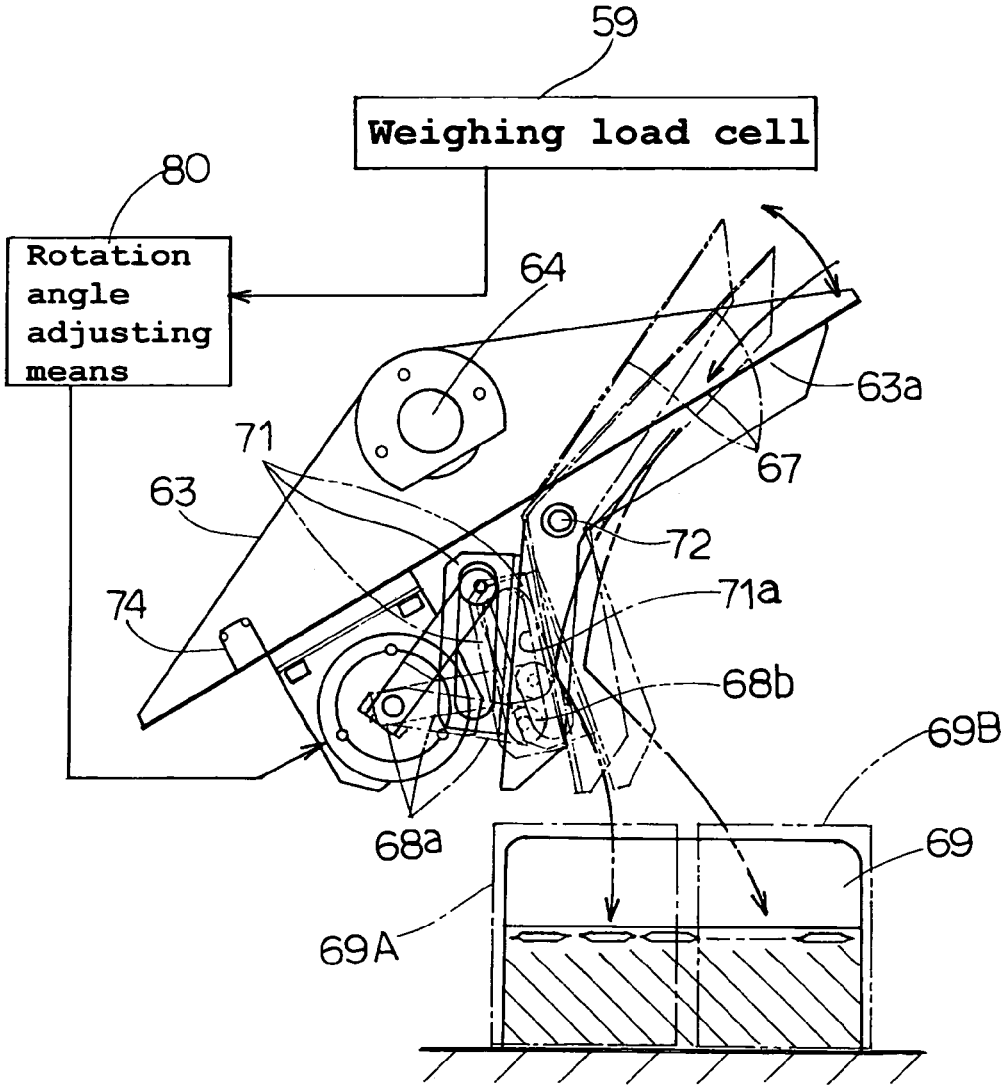
FIG. 14 is an enlarged side view of principal portions of a defective item discharging means of another weighing machine according to Embodiment 2 of the present invention.

As shown in FIG. 14, the rotation angles of the opening/closing lid 67 and the discharging guide 70 may be made adjustable, based on a weighing signal from the weighing load cell 59, by means of a rotation angle adjusting means 80 provided in a control circuit in control panel 39. Specifically, a circuit is arranged so that each time a defective stick packaging 12B is detected, the lid opening angle of the opening/closing lid 67 and the rotation angle of the discharging guide 70 are changed by small angles at a time in multiple stages and in a fixed cycle. Defective stick packagings 12B can thereby be prevented from dropping in a biased manner onto a single location inside the defective item recovery box 69, and defective stick packagings 12B can thus be dropped substantially uniformly over the entire range of the interior of the defective item recovery box 69. Collapsing to the exterior of the box, etc., of a large amount of defective stick packagings 12B that are heaped despite there being an allowance in the containment space inside an upper portion of the defective item recovery box 69 can thereby be prevented. The recovery amount of defective stick packagings 12B that can be recovered in the defective item recovery box 69 without using manpower can also be increased.

Also, as another control method using the rotation angle adjusting means 80, the position of dropping of the defective stick packaging 12B, guided by the discharging guide 70, is changed to enable the position of recovery of the defective stick packaging 12B to be changed according to defect conditions, such as overweight and underweight. Defective stick packagings 12B that differ in defect conditions can thus be recovered separately in a plurality of defective item recovery boxes 69A and 69B.

In these examples, the rotation angle of the opening/closing lid 67 is made variable. However, it shall be deemed that at least in the lid opening process of the opening/closing lid 67, an angle that enables the passage of a defective stick packaging 12B through the defective item outlet 63*a* is secured at all times.

The invention claimed is:

1. A packaging machine comprising a longitudinal seal forming unit that forms a pre-packaging body by forming a packaging sheet into a cylindrical shape by overlapping the longitudinal edges of a single packaging sheet having a strip shape or opposed longitudinal edges of two packaging sheets each having a strip shape and sealing the overlap of the packaging sheets, a lateral seal forming unit that seals the lower end of the pre-packaging body, a contents supply unit for loading a predetermined amount of contents into the pre-packaging body, a cutting unit that, after the upper end of the pre-packaging body loaded with the contents has been sealed by the lateral seal forming part, cuts the upper end seal part of the pre-packaging body, and a packaging discharging unit that discharges the package body obtained from the cutting unit to the outside of the machine, wherein the packaging discharging unit comprises a housing, a weighing bucket in the housing that receives the package body, a weighing load cell that measures the weight of the package body provided on the weighing bucket, a discharging chute that discharges the weighed package body to the outside of the machine, an opening/closing lid that discharges defective package bodies judged by weighing with the weighing load cell to be outside a weight range of non-defective packaging bodies from a defective item outlet, formed in a portion of the discharging chute, by opening and closing the defective item outlet by rotation within a vertical plane, and a discharging guide affixed to the opening/closing lid that contacts and guides the defective packaging bodies discharged from the defective item outlet to a defective item recovery box.

2. The packaging machine according to claim 1, wherein there is a rotation angle adjusting means that adjusts the angles of rotation of the opening/closing lid and the discharging guide and changes the position for the drop of the defective packaging bodies.

3. The packaging machine according to claim 2, wherein the rotation angle adjusting means adjusts the angles of rotation of the opening/closing lid and the discharging guide in a fixed cycle of multiple stages.

* * * * *